US007418745B2

(12) United States Patent
Paesang et al.

(10) Patent No.: US 7,418,745 B2
(45) Date of Patent: Sep. 2, 2008

(54) PLAYYARD WITH BASSINET

(75) Inventors: Chinawut Paul Paesang, Cumberland, RI (US); Geoff Swales, Somerset, MA (US)

(73) Assignee: Cosco Management, Inc., Wilmington, DE (US)

( * ) Notice: Subject to any disclaimer, the term of this patent is extended or adjusted under 35 U.S.C. 154(b) by 312 days.

(21) Appl. No.: 11/125,922

(22) Filed: May 10, 2005

(65) Prior Publication Data

US 2006/0253978 A1 Nov. 16, 2006

(51) Int. Cl.
*A47D 7/00* (2006.01)
*A47D 13/06* (2006.01)

(52) U.S. Cl. ..... 5/98.1; 5/93.1; 5/99.1

(58) Field of Classification Search ..... 5/93.1–99.1, 5/102

See application file for complete search history.

(56) References Cited

U.S. PATENT DOCUMENTS

| | | | | |
|---|---|---|---|---|
| 3,311,934 | A | 4/1967 | Goldberg | |
| 5,339,470 | A | 8/1994 | Shamie | |
| 5,553,336 | A | 9/1996 | Mariol | |
| 5,778,465 | A | 7/1998 | Myers | |
| 5,867,850 | A | 2/1999 | Mariol | |
| 5,918,329 | A | 7/1999 | Huang | |
| 6,173,462 | B1 | 1/2001 | Huang et al. | |
| 6,182,308 | B1 | 2/2001 | Yang | |
| 6,192,535 | B1 | 2/2001 | Warner, Jr. et al. | |
| 6,233,759 | B1 | 5/2001 | Warner, Jr. et al. | |
| 6,418,575 | B1 | 7/2002 | Cheng | |
| 6,430,762 | B1 | 8/2002 | Cheng | |
| 6,434,767 | B1 | 8/2002 | Welsh, Jr. | |
| 6,526,608 | B1 | 3/2003 | Hsia | |
| 6,539,563 | B1 | 4/2003 | Hsia | |
| 6,543,070 | B2 | 4/2003 | Longenecker et al. | |
| 6,634,038 | B2 | 10/2003 | Hsia | |
| 6,735,796 | B2 | 5/2004 | Warner, Jr. et al. | |
| D500,213 | S | 12/2004 | DeHart et al. | |
| 6,895,611 | B2 | 5/2005 | Tharalson et al. | |
| 6,901,613 | B1 | 6/2005 | Hsia | |
| 6,907,626 | B1 | 6/2005 | Welsh, Jr. et al. | |
| 6,948,197 | B1 | 9/2005 | Chen | |
| 7,003,821 | B2 | 2/2006 | DeHart et al. | |
| 7,013,505 | B2 | 3/2006 | Martin | |
| 7,043,779 | B2 | 5/2006 | Mendenhall et al. | |
| 7,055,191 | B1 | 6/2006 | Chen | |
| 2004/0261174 | A1 | 12/2004 | DeHart et al. | |
| 2006/0225205 | A1* | 10/2006 | Troutman | 5/93.1 |
| 2006/0253980 | A1* | 11/2006 | Paesang et al. | 5/99.1 |

* cited by examiner

*Primary Examiner*—Alexander Grosz
(74) *Attorney, Agent, or Firm*—Barnes & Thornburg LLP

(57) ABSTRACT

A juvenile playyard including a bassinet assembly mountable on a frame of the playyard and including a bassinet couplable to the frame in a use position across a portion of a top opening of the playyard.

23 Claims, 7 Drawing Sheets

26
28
34
34
32
32
32
32
33
33
32
30

16
30
28

20A
44
P3
20B
20
24
50
51
50
18A
40
P2
10
50
18
18B
12
22B
19A
14
P4
19B
22
46
19
22A
14
50
42
38
P1
36
36
16
36
25

PLAYYARD WITH BASSINET

BACKGROUND

The present disclosure relates to juvenile playyards, and particularly to playyards having bassinets. More particularly, the present disclosure relates to a fabric bassinet mountable across a portion of a top opening of a playyard.

SUMMARY

According to the present disclosure, a playyard includes a frame having two side rails and two end rails that cooperate to form a top opening of the playyard. Also included is a fabric frame cover overlying the frame. The playyard further includes a bassinet assembly that has a cross-bar mountable on the frame in a position spanning across the top opening at substantially a midpoint of the two side rails.

The bassinet assembly includes a fabric bassinet coupled to the cross-bar and removably coulpable in a use position to the fabric frame cover overlying the two side rails and one of the end rails.

Other aspects of the present disclosure will become apparent from the following descriptions when considered in conjunction with the accompanying drawings.

BRIEF DESCRIPTION OF THE DRAWINGS

The detailed description particularly refers to the accompanying figures in which.

DETAILED DESCRIPTION

Generally, the present disclosure relates to a bassinet assembly removably mountable on a playyard frame across a top opening of the playyard at essentially a mid-point of two-spaced apart side rails of the playyard. The bassinet assembly includes a fabric bassinet that is couplable in a use position across a portion of the top opening to portions of a fabric frame cover overlying the two-spaced apart side rails and one of two spaced-apart end rails. The coupling of the fabric bassinet to the fabric frame cover is configured such that the fabric bassinet is essentially maintained in the use position when an upward or downward force is exerted on the fabric bassinet from within the top opening, thereby preventing an undesired uncoupling of the fabric bassinet from the fabric frame cover.

Figures 1A, 1B:
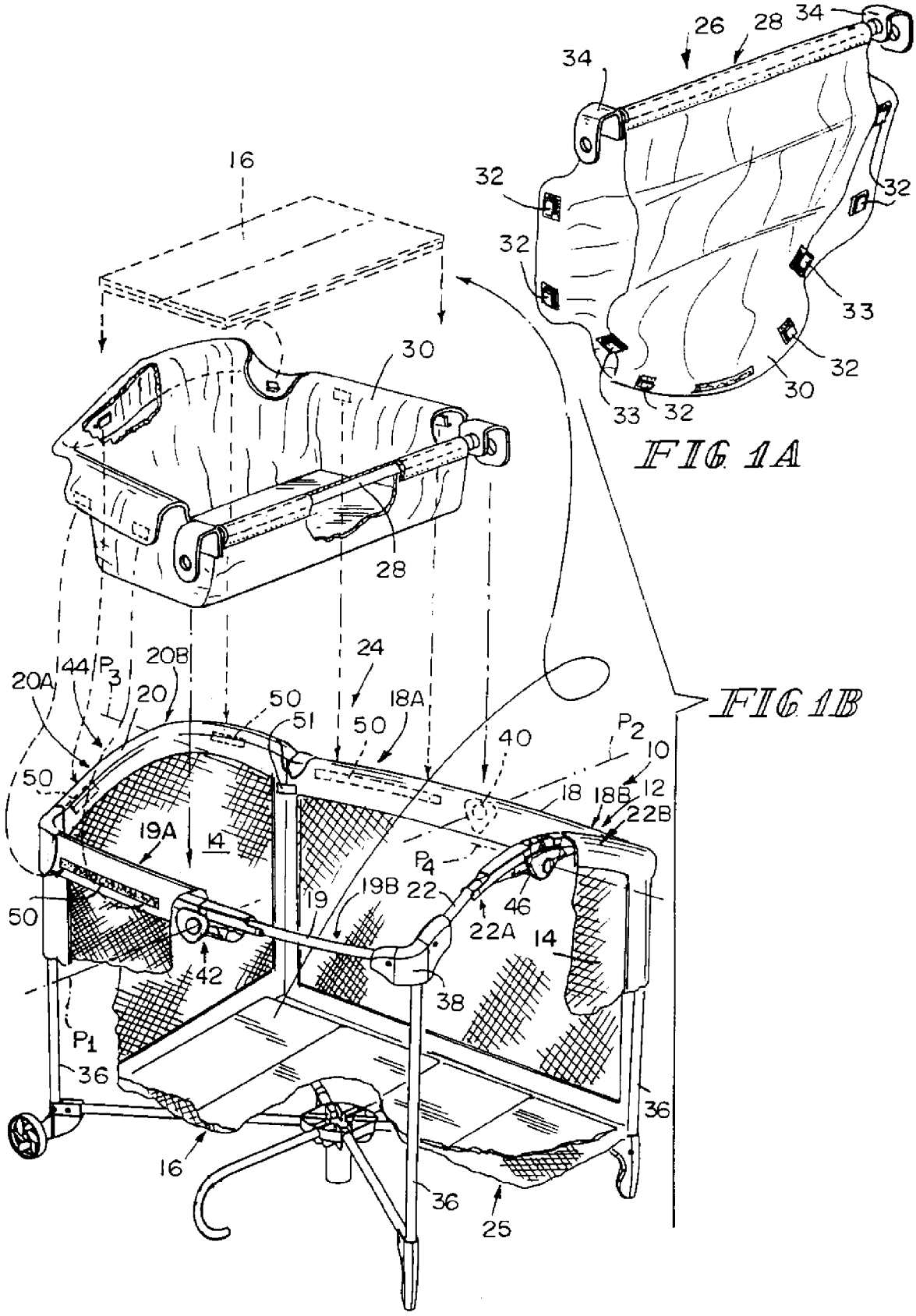
FIG. 1A is a perspective view of a bassinet assembly in accordance with the present disclosure including a fabric bassinet in a substantially unstructured state hanging downwardly from and coupled to a cross-bar, the cross-bar including frame connectors configured to be mountable, for example, on a frame of a playyard, and the fabric bassinet including bassinet connectors and fabric connectors configured to be couplable to a fabric frame cover overlaying the frame of the playyard.
FIG. 1B is an exploded, perspective view of a playyard, with portions broken away, in accordance with the present disclosure showing a playyard frame, a fabric frame cover, and the bassinet assembly of FIG. 1A shown here substantially as it would be configured in a substantially structured state after installation across a top opening of the playyard.

More specifically, as shown in FIGS. 1A and 1B, playyard 10 includes a collapsible frame 12, fabric frame cover 14 and removable floor mat 16. Frame 12 includes two spaced-apart side rails 18, 19 and spaced-apart first and second end rails 20, 22, all cooperating to form a top opening 24 of the playyard 10. Playyard 10 also includes a bassinet assembly 26 including a cross-bar 28 and a fabric bassinet 30. Fabric bassinet 30 is shown in FIG. 1A in a substantially unstructured state coupled to and hanging downwardly from cross-bar 28. Fabric bassinet 30 includes bassinet connectors 32 and fabric connectors 33 configured to couple the fabric bassinet 30 to fabric frame cover 14. Cross-bar 28 includes frame connectors 34, shown, for example, as J-shaped clips, configured to be mountable on collapsible frame 12, at substantially a mid-point of side rails 18, 19, as suggested in FIG. 1B. Fabric bassinet 30 is shown, for example, in a substantially structured state in FIG. 1B as it would appear when bassinet assembly 26 and fabric bassinet 30 are coupled to collapsible frame 12 and installed in a use position in playyard 10, as shown in FIG. 2.

The structure of playyard 10 is similar in many respects to the playyard disclosed in U.S. patent application No. 10/353,378, filed Jan. 29, 2003, now U.S. Pat. No. 7,043,779. The similarities and differences will be apparent as the present disclosure unfolds below.

Collapsible frame 12 includes four corner legs 36 and a corner piece 38 at the top end of each corner leg 36. Side rails 18, 19 and first and second end rails 20, 22 are interconnected by corner pieces 38. Each side rail 18, 19 includes a first segment 18A, 19A, respectively, coupled to a second segment 18B, 19B, respectively, for pivotable movement about pivot axis $P_1$ and $P_2$, respectively, on side rail locking mechanisms 40, 42, respectively. First end rail 20 includes a first segment 20A coupled to second segment 20B for pivotal movement about pivot axis $P_3$ on first end rail locking mechanism 44, and second end rail 22 includes a first segment 22A coupled to second segment 22B for pivotal movement about pivot axis $P_4$ on second end rail locking mechanism 46. Each rail locking mechanism 40, 42, 44, 46 is located at substantially a midpoint of each respective rail 18, 19, 20, 22 and includes an actuator 48 for disengaging each respective locking mechanism 40, 42, 44, 46 to permit the playyard to be placed in a collapsed configuration (not shown). Actuator 48 is shown, for example, as a button-like element or protrusion extending outwardly from each rail locking mechanism 40, 42, 44, 46.

Figure 2:
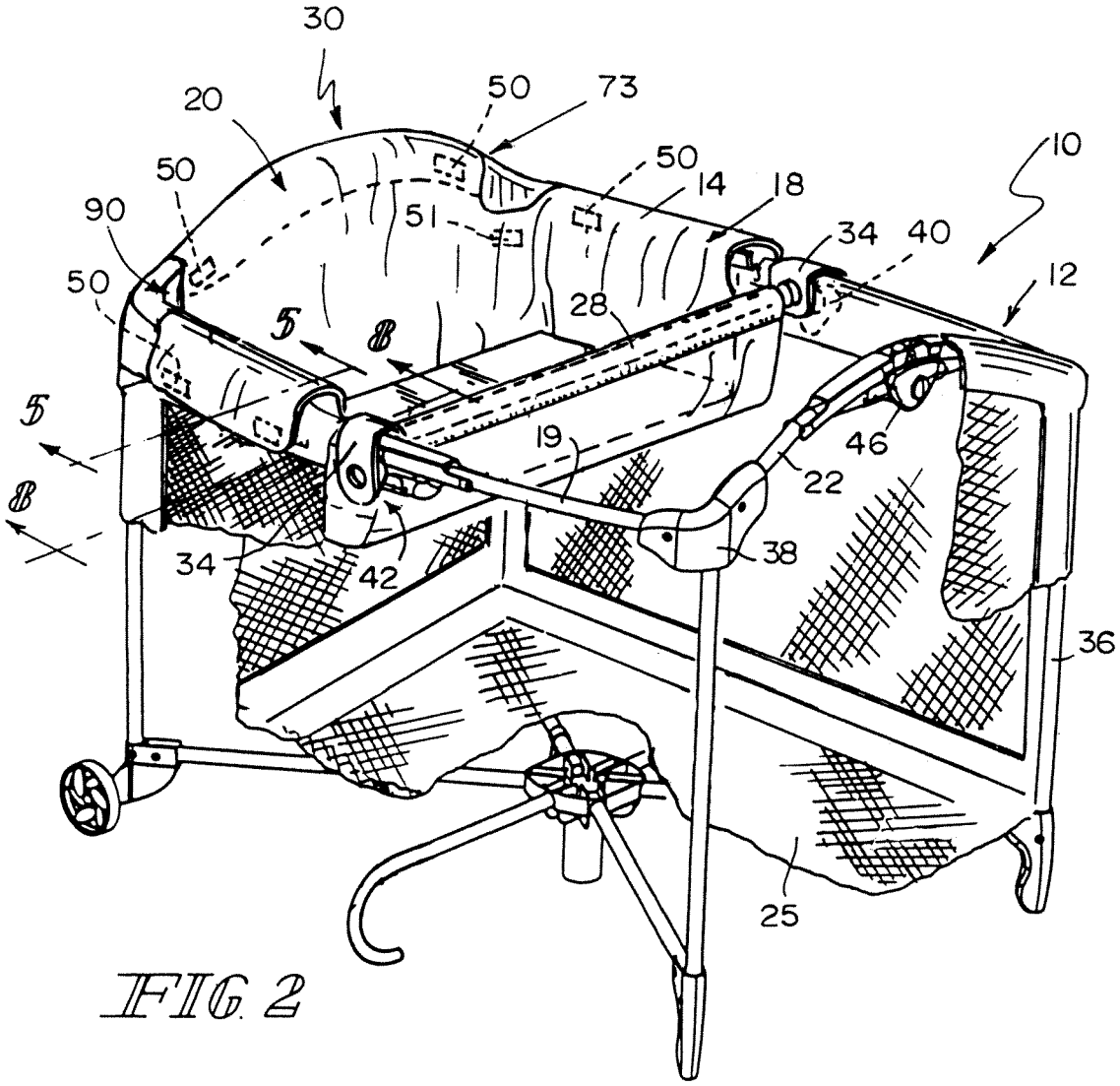
FIG. 2 is a perspective view of the playyard of FIG. 1B, with portions broken away, showing the bassinet assembly installed in the playyard.
Figure 8:
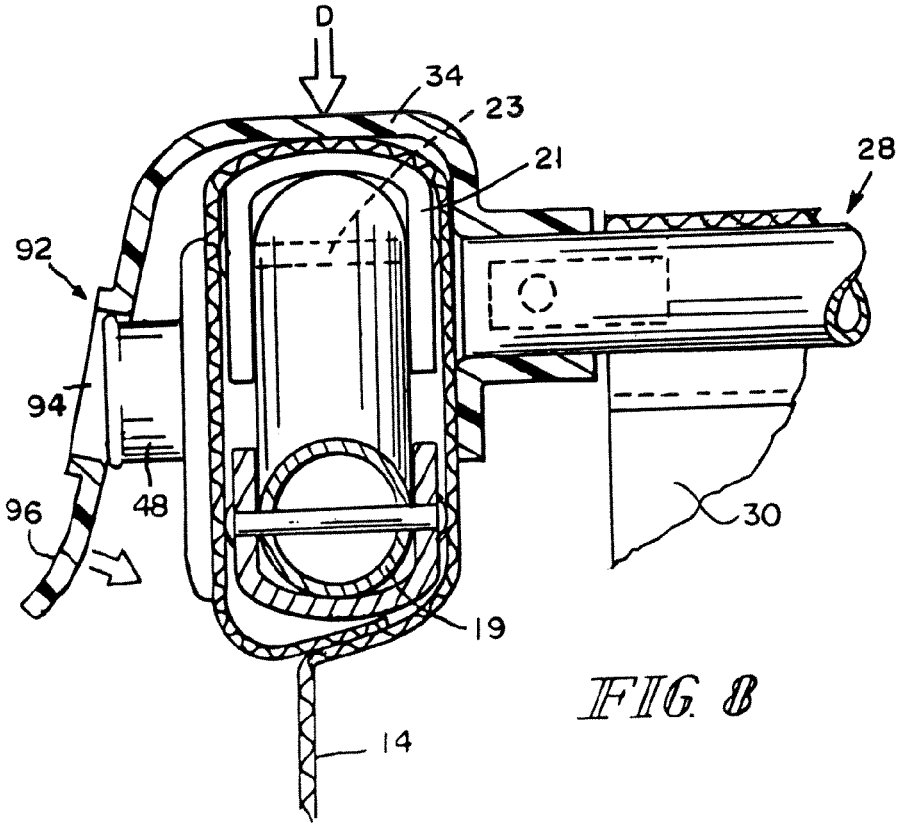
FIG. 8 is a sectional view taken along line 8-8 of FIG. 2 showing the frame connector in the process of being coupled to a receiver element on a side rail locking mechanism of the playyard.
Figure 9:
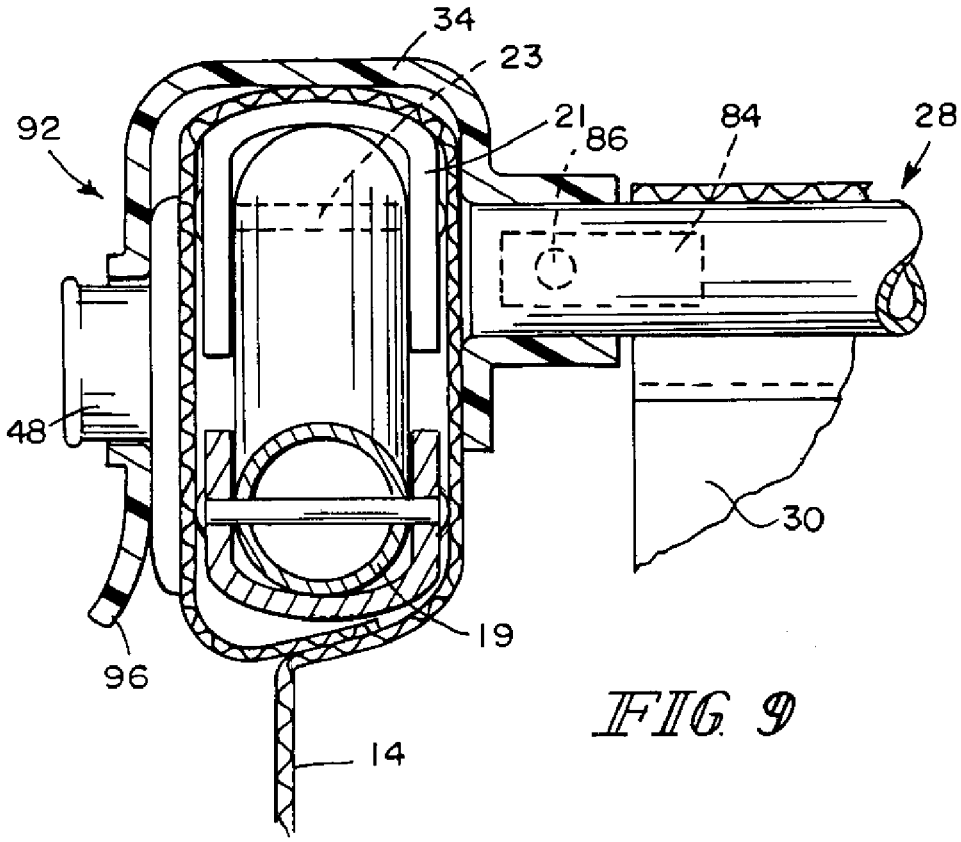
FIG. 9 is a sectional view, similar to that of FIG. 8, showing the frame connector coupled to the receiver element on the side rail locking mechanism.
Figure 10:
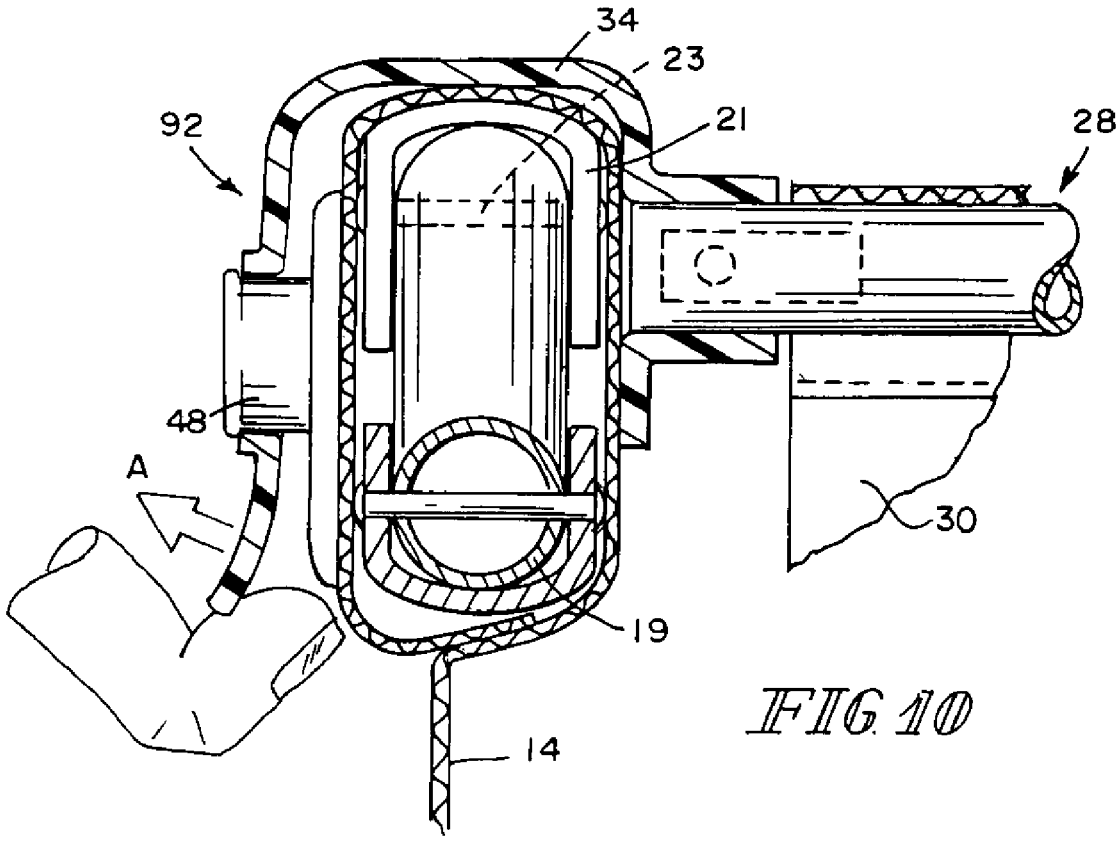
FIG. 10 is a sectional view, similar to that of FIG. 8, showing a person's finger applying a force to an interior surface of a free end or lip on the frame connector to uncouple the frame connector from the receiver element on the side rail locking mechanism.

As suggested in FIGS. 1B and 2 and as shown, for example, in FIGS. 8-10, collapsible frame 12 also includes rail extenders 21 pivotably connected by pins 23 to each rail segment 18A, 18B, 19A, 19B, 20A, 20B, 22A, 22B and configured to overlie portions of each rail segment 18A, 18B, 19A, 19B, 20A, 20B, 22A, 22B, and portions of each rail locking mechanism 40, 42, 44, 46, thereby creating a relatively smooth and essentially continuous surface between each pair of respective pivotably connected rail segments.

Figure 3A:
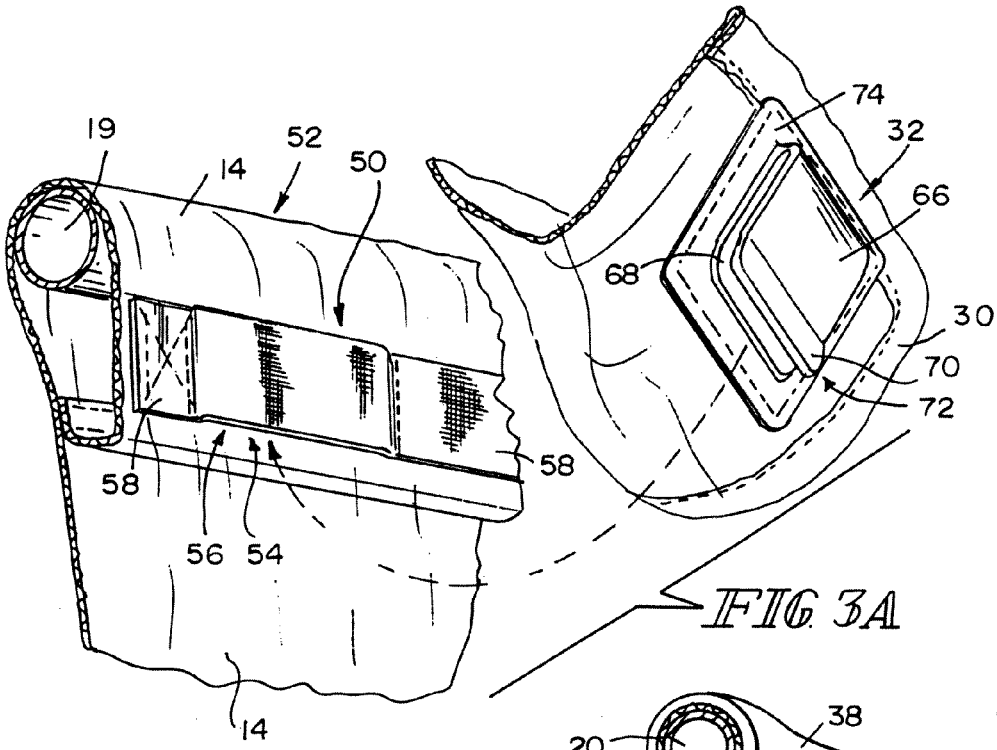
FIG. 3A is an enlarged, exploded perspective view, with portions broken away, showing one of the bassinet connectors of FIG. 1A on the fabric bassinet and configured to be couplable in an upward direction (as suggested by the arrow) to a receiver on the fabric frame cover.
Figure 3C:
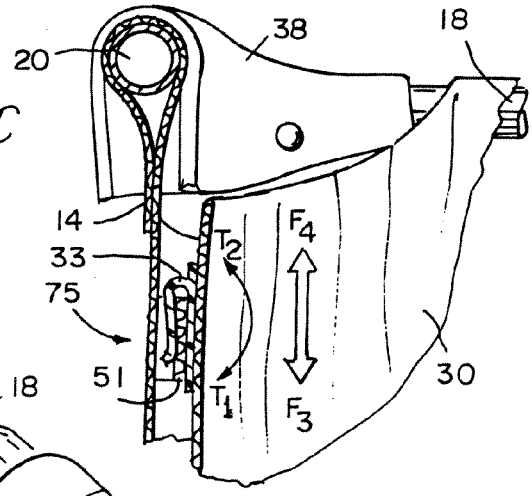
FIG. 3C is a sectional view taken along line 3C-3C of FIG. 3B, showing one of the fabric connectors coupled to one of the receivers on the fabric frame cover and forming a coupling.
Figure 3B:
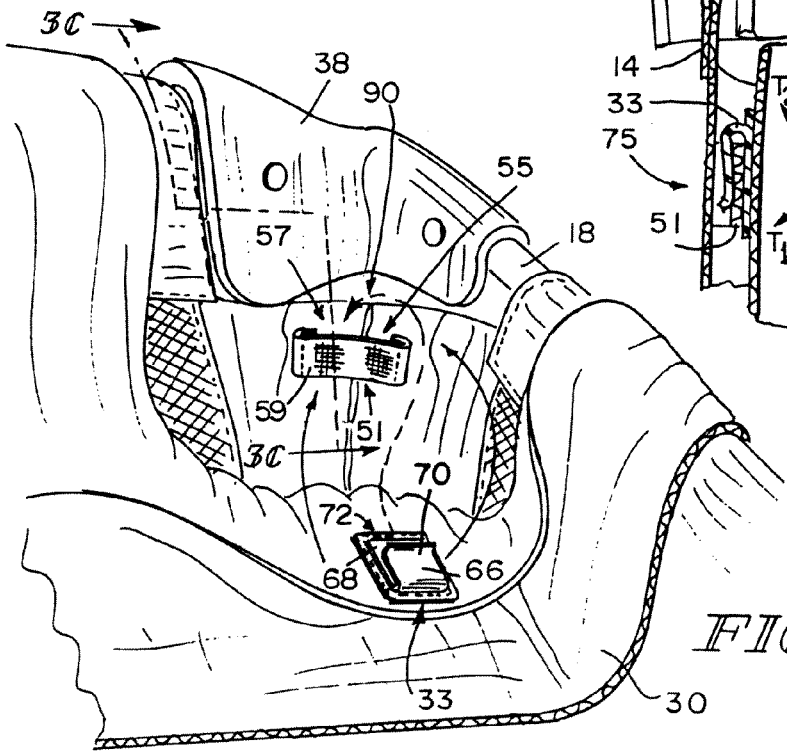
FIG. 3B is an enlarged, exploded perspective view, with portions broken away, showing one of the fabric connectors of FIG. 1A on the fabric bassinet and configured to be couplable in a downward direction (as suggested by the arrow) to a receiver on the fabric frame cover.
Figure 4:
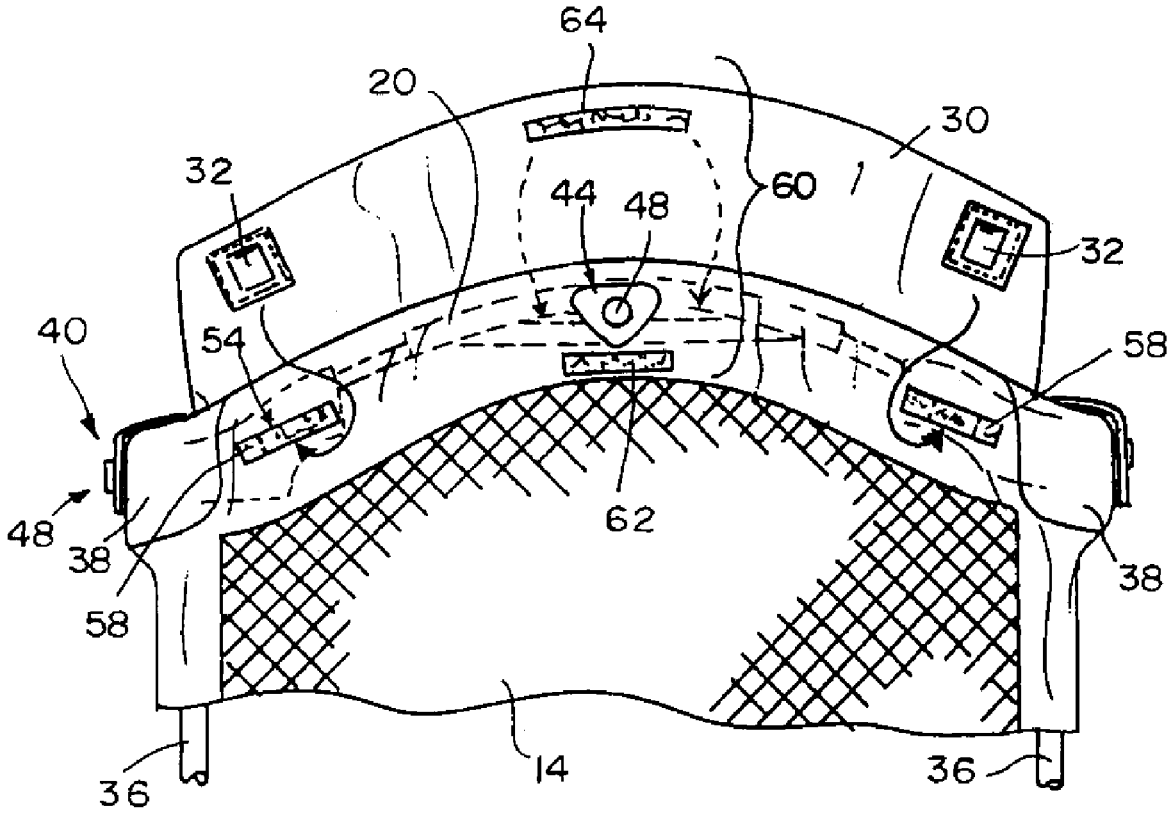
FIG. 4 is an end view of the playyard of FIG. 2, with portions broken away, showing an end portion of the fabric bassinet configured to be draped over an end rail of the playyard, the end portion including bassinet connectors configured to be couplable in an upward direction to receivers on the fabric frame cover.

Fabric frame cover 14 overlies collapsible frame 12 and is made of a sturdy fabric and netting material that is foldable to enable collapsible frame 12 to be moved from an erected position, as shown in FIG. 11B, to a collapsed position (not shown). Fabric frame cover 14 includes a plurality of receivers 50, 51 attached or connected on an outer or exterior surface 52 of portions of the fabric frame cover 14 that overlie portions of side rails 18, 19 and one of end rails 20, 22, and shown in FIGS. 1B and 2 as first end rail 20. One of the receivers 50 is best seen, for example, in FIG. 3A. Receiver 50 is configured as a loop 54 created by an opening 56 between a portion of strap 58 and fabric frame cover 14. Strap 58 is shown attached to fabric frame cover 14 by, for example, sewing. One of the receivers 51 is best seen in FIG. 3B. Receiver 51 is also configured as a loop 55 created by an opening 57 between a portion of strap 59 and fabric frame cover 14. It is within the scope of the present disclosure that straps 58 and 59 may be attached to fabric frame cover 14 by other means than sewing and that loops 54 and 55 and/or openings 56 and 57 may be created on fabric frame cover 14 by other configurations. Fabric frame cover 14 also includes one part of a securing mechanism 60, such as hook-type material 62, configured to cooperate with another part of securing mechanism 60, such as loop-type material 64 on fabric bassinet 30, to removably secure fabric frame cover 14 to fabric bassinet 30 at first end rail 20, as suggested, for example, in FIG. 4.

Bassinet assembly 26 includes cross-bar 28 and fabric bassinet 30 connected to the cross-bar 28. Fabric bassinet 30 includes a plurality of bassinet connectors 32 and 33 shown in FIGS. 3A and 3B, for example, as U-shaped clips that are attached to the fabric bassinet 30. Bassinet connectors 32 are attached and oriented such that they are couplable in an upward direction toward top opening 24 to the loops 54 on the fabric frame cover 14, as suggested in FIG. 3A. Fabric connectors 33 are attached and oriented such that they are couplable in a downward direction toward floor 25 of the playyard 10 to loops 55 adjacent corner pieces 38, as suggested in FIG. 3B and shown in FIG. 3C. Each U-shaped clip 32 includes legs 66 and 68 and a lip 70 angled and extending outwardly away from leg 68 and opening 72 between legs 66 and 68 so as to facilitate the forming of a coupling 73 of clip 32 and loop 54, as seen, for example, in FIGS. 5 and 6. Clip 32 is shown in FIG. 3A as being connected to a semi-rigid backing material 74 that is attached to fabric bassinet 30 by, for example, sewing and providing support for clip 32. Each U-shaped clip 33 is configured similarly to clip 32 but, as noted above, is oriented to facilitate the forming of coupling 75 (see FIGS. 3B and 3C) that assists in minimizing the size of a potential gap 90 that may form between fabric bassinet 30 and frame 12 adjacent corner pieces 38 at each end of first end rail 20, as suggested in FIGS. 2 and 3B. It is within the scope of the present disclosure that clips 32, 33 and receivers 50, 51 may include different configurations cooperating to form couplings 73, 75, respectively.

Figure 7:
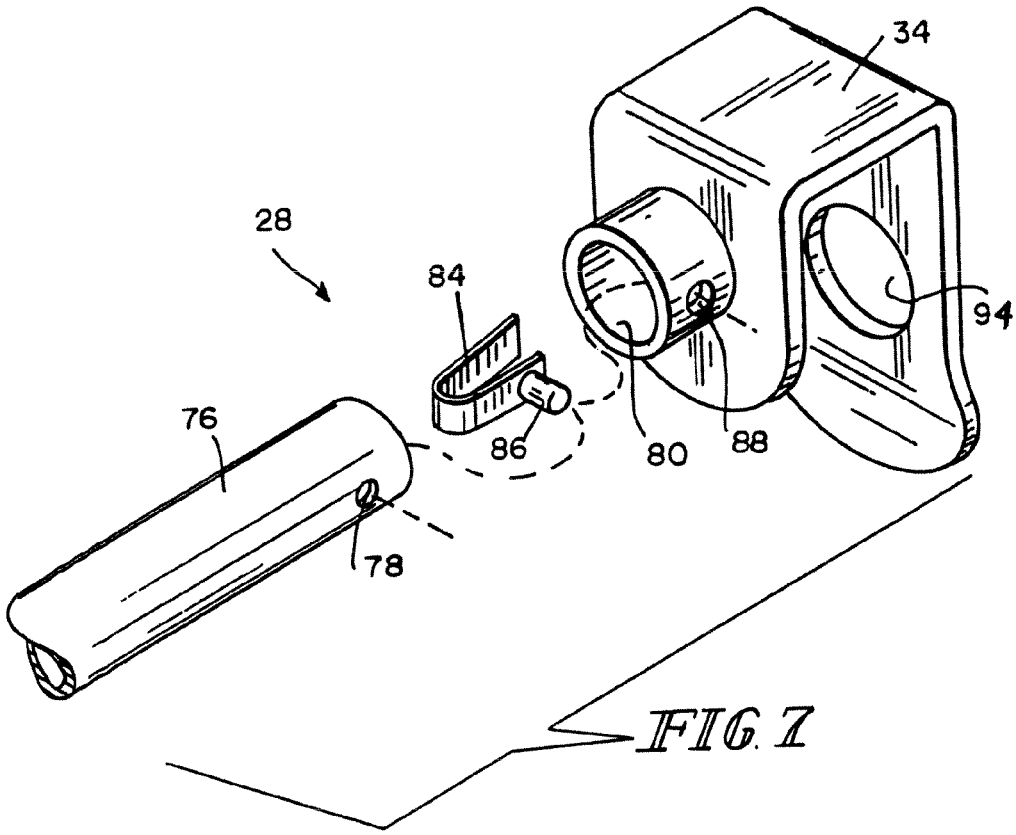
FIG. 7 is an enlarged, exploded perspective view of a portion of the cross-bar of FIG. 1A showing one of the frame connectors configured to be coupled to a rod of the cross-bar.

Cross-bar 28 includes rod 76, having an opening 78 at each end (only one end shown in FIG. 7), frame connectors 34, shown, for example, in FIG. 7 as J-shaped clips 34, each clip 34 includes a bushing 80 configured to receive an end of rod 76 in bushing opening 82, as suggested in FIG. 7. Cross-bar 28 also includes rod connector 84 having a protrusion or pin 86. Rod connector 84 is shown as a U-shaped spring-like element configured to be insertable inside rod 76 and to then have pin 86 protrude through opening 78 exterior to rod 76, as suggested in FIG. 7. Rod 76 is then insertable into bushing 80 compressing spring-like element 84 which then permits pin 86 to slide into bushing 80 and then snap through opening 88 on bushing 80, thereby connecting rod 76 to J-clip 34.

As noted above, bassinet assembly 26 also includes frame connectors 34, shown, for example, as J-shaped clips (see FIGS. 1A, 1B and 7-10) and attached on each end of cross-bar 28. Each clip 34 includes an elongated side 92 having a through-opening 94 (see FIG. 7) configured to mate or couple to actuator or protruding element 48, as suggested in FIGS. 8 and 9. Each clip 34 also includes a free end or lip 96 configured to be manipulable by a person's finger in order to uncouple clip 34 from protruding element 48, as suggested in FIG. 10.

It is within the scope of the present disclosure that the receivers 50, 51 can be located on different and/or additional portions of fabric frame cover 14 overlying side rails 18, 19 and second end rail 22. That provides the option that fabric bassinet 30 is extendable toward and mountable, in the use position, on fabric frame cover 14 overlying either end rail 20 or 22. Similarly, clips 32 and 33 can be located on different portions of fabric bassinet 30 and/or additional or fewer clips 32 and 33 can be used.

Turning now to the mounting of bassinet assembly 26 to playyard 10 and coupling of the fabric bassinet 30 to fabric frame cover 14. Clips 34 are constructed of a resiliently flexible material. When cross-bar 28 is to be mounted on frame 12, clips 34 are positioned over side rail locking mechanisms 40, 42 and clips 34 are lowered into position atop mechanisms 40, 42. A downward pressure, as suggested by arrow D in FIG. 8, on the clips 34 (only one clip 34 shown), which pressure can also be applied to cross-bar 28, results in through-openings 94 automatically snapping into place over protruding elements 48, as suggested in FIGS. 8 and 9, thereby removably securing cross-bar 28 to frame 12.

Fabric bassinet 30, hanging downwardly from cross-bar 28 is extendable toward first end rail 20 to be coupled to fabric frame cover 14. Bassinet clips 32 are coupled to respective receivers 50 by inserting clips 32 into loops 54 along side rails 18, 19 and first end rail 20 in an upward direction toward top opening 24 of the playyard 10, forming couplings 73, as suggested in FIG. 3A, and which couplings 73 are shown, for example, in FIGS. 5 and 6. Fabric cover clips 33 are coupled to respective receivers 51 by inserting clips 33 into loops 55 adjacent corner pieces 38 in a downward direction toward floor 25 forming coupling 75, as suggested in FIGS. 2 and 3B. Securing mechanism 60 is also engaged by mating the hook 62 and loop 64 connectors, thereby providing an additional connection of fabric bassinet 30 to fabric frame cover 14 and allowing a portion of fabric bassinet 30 to cover actuator 48 of first end rail locking mechanism 44, as suggested in FIG. 4.

Figure 5:
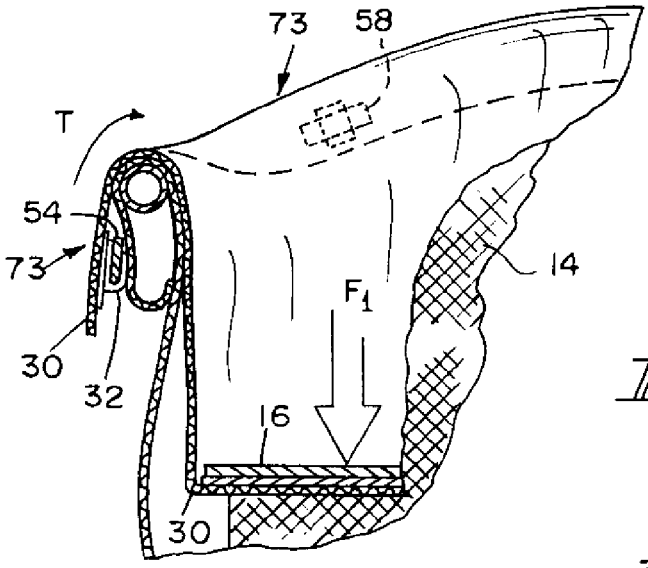
FIG. 5 is a sectional view taken along line 5-5 of FIG. 2, with portions broken away, showing a coupling of a bassinet connector on the fabric bassinet to a receiver on the fabric frame cover, and further showing that a downward force on the fabric bassinet from within the top opening of the playyard results in a tensioning of the coupling of the bassinet connector to the receiver, as suggested by the movement and force arrows.
Figure 6:
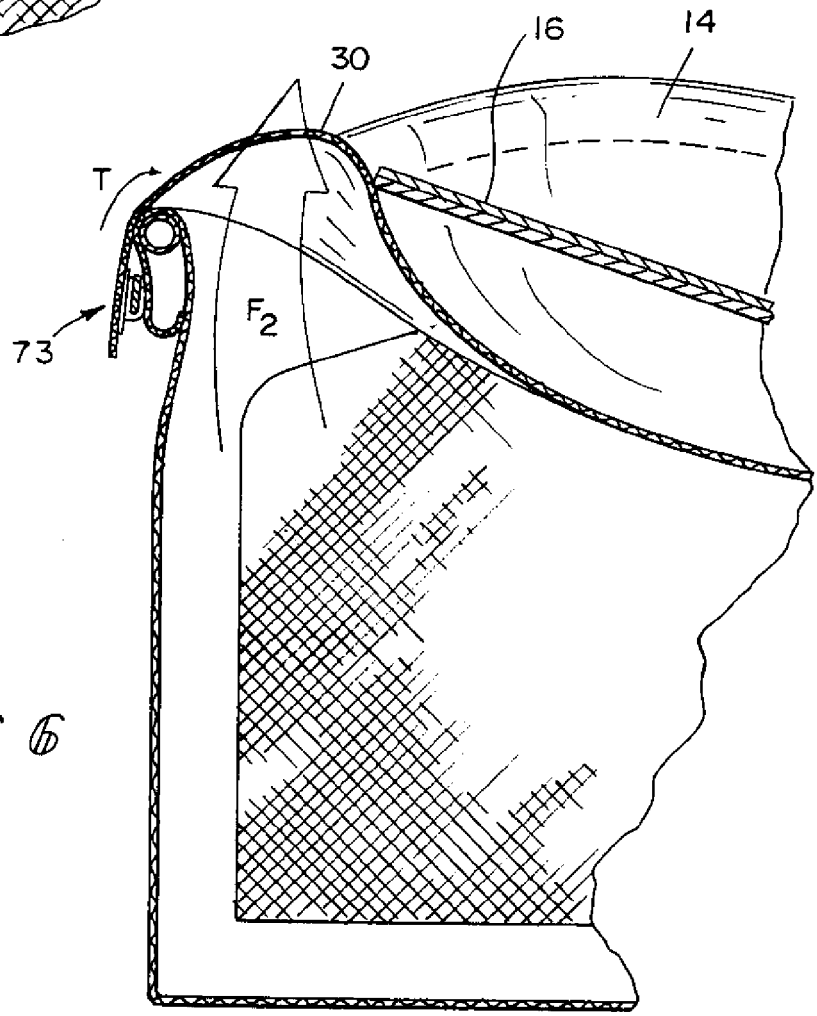
FIG. 6 is a sectional view similar to FIG. 5, with portions broken away, showing the coupling of the fabric bassinet to the fabric frame cover, and further showing an upward force on the fabric bassinet from within the top opening of the playyard resulting in a tensioning of the coupling, as suggested by the movement and force arrows.

Couplings 73 are designed such that, if a downward or upward force, as suggested by arrows $F_1$ and $F_2$ in FIGS. 5 and 6, respectively, is exerted on fabric bassinet 30 from within top opening 24, a possible decoupling of the fabric bassinet 30 from fabric frame cover 14 is minimized or prevented because of a tensioning of couplings 73, as suggested by arrow T in FIGS. 5 and 6. As suggested in FIG. 3C, coupling 75 is tensioned by a downward force $F_3$ from within top opening 24. Coupling 75 may be somewhat tensioned and/or twisted (see arrows $T_1$ and $T_2$ in FIG. 3C) by an upward force $F_4$ from within top opening 24, as suggested by arrows $F_4$, $T_1$ and $T_2$ in FIG. 3C. The upward force $F_4$ will more likely cause a twisting of coupling 75, as suggested by arrows $T_1$ and $T_2$, as opposed to causing a straight raising of clip 33 to approach a decoupling of coupling 75. That is because clip 33 is rigid and loop 55 is flexible, and a movement of the fabric of fabric bassinet 30 around or adjacent clip 33 will contribute to the above-referenced twisting of coupling 75. The amount of tensioning or twisting of couplings 75 may vary depending on the location within the top opening 24 from which the upward and/or downward forces originate.

Coupling 73 and 75 do cooperate to resist an uncoupling of the fabric bassinet 30 from the fabric frame cover 14 when an upward force is applied to the fabric bassinet 30 in the use position from within the top opening 24. Particularly, for example, the proximity of couplings 75 to coupling 73 on first end rail 20 and to couplings 73 on side rails 18, 19 that are closest to first end rail 20, is such that couplings 75 may function to lessen or diminish a tensioning of the just-mentioned couplings 73 when an upward force $F_1$ is applied to the fabric bassinet 30 in the use position from within the top opening 24. Such a lessening or diminishing effect may result from a limiting of the distance that portions of the fabric bassinet 30 may be moved when the upward force is applied. Despite this effect, the cooperation of couplings 73 and 75 still results in a resistance to or prevention of the uncoupling of the fabric bassinet 30 from fabric frame cover 14 when the upward force is applied.

To uncouple fabric bassinet 30 from frame 12, bassinet clips 32 are moved in a downward direction toward the floor 25 and removed from loops 54. Fabric cover clips 33 are moved in an upward direction toward top opening 24 and removed from loops 55. As suggested in FIG. 10, frame connector 34 is uncoupled from protruding element 48 by moving free end or lip 96 a sufficient distance, in the direction of arrow A, for example, by a person's finger, to disengage through-opening 94 from protruding element 48. Cross-bar 28 may now be used to remove bassinet assembly 26 from playyard 10.

Although the present disclosure has been described and illustrated in detail, it is to be clearly understood that this is done by way of illustration and example only and is not to be taken by way of limitation. The scope of the present disclosure is to be limited only by the terms of the appended claims.

We claim:

1. A playyard comprising a frame including a fabric frame cover overlying the frame, two spaced-apart side rails and two spaced-apart end rails, the two spaced-apart side rails and two spaced-apart end rails cooperating to form a top opening of the playyard, a bassinet assembly mountable on the frame and including a cross-bar couplable to the playyard in a position spanning across the top opening at substantially a midpoint of each of the two spaced-apart side rails, and a fabric bassinet coupled to the cross-bar and configured to be extendable across a portion of the top opening and removably couplable to portions of the fabric frame cover overlying the two spaced-apart side rails and one of the two spaced-apart end rails, thereby placing the fabric bassinet in a use position; and wherein the fabric bassinet includes a plurality of bassinet connectors and the fabric frame cover includes a plurality of receivers on an exterior surface of the fabric frame cover, each bassinet connector configured to be coupled to one of the plurality of receivers to form a first coupling.

2. The playyard of claim 1, wherein each bassinet connector is coupled to one of the plurality of receivers in an upward direction toward the top opening of the playyard to form the coupling, thereby removably securing the fabric bassinet to the fabric frame cover in the use position.

3. The playyard of claims 2, wherein when one or more of an upward and downward force is exerted on the fabric bassinet in the use position, each first coupling remains coupled, thereby preventing an uncoupling of the fabric bassinet from the fabric frame cover.

4. The playyard of claim 1, wherein each of the plurality of bassinet connectors are U-shaped clips.

5. The playyard of claim 4, wherein each of the plurality of receivers is a loop formed on the exterior surface of the fabric frame cover.

6. The playyard of claim 5, wherein each of the U-shaped clips is coupled to one of the loops in an upward direction toward the top opening of the playyard to form a coupling and removably secure the fabric bassinet to the fabric frame cover.

7. The playyard of claim 1, further including a pair of side rail locking mechanisms, each side rail locking mechanism located at substantially a mid-point of one of the two spaced-apart side rails, and each side rail locking mechanism including a protruding element extending exterior to the playyard.

8. The playyard of claim 1, further including a floor mat configured to be foldable and insertable into the fabric bassinet to form a solid bottom in the fabric bassinet when the fabric bassinet is coupled to the fabric frame cover in the use position.

9. The playyard of claim 1, wherein the fabric bassinet further includes a pair of fabric frame connectors and the fabric frame cover includes a pair of fabric receivers, each fabric frame connector configured to be coupled to one of the pair of fabric receivers to form a second coupling, each second coupling being located immediately adjacent an intersection of one of the two spaced-apart end rails and the two spaced-apart side rails, and each second coupling acting to minimize a gap between the fabric bassinet and the fabric frame cover at one of the intersections.

10. The playyard of claim 9, wherein the first and second couplings cooperate to prevent an uncoupling of the fabric bassinet from the fabric frame cover when an upward force is exerted on the fabric bassinet in a use position from within the top opening.

11. A playyard comprising a frame including a fabric frame cover overlying the frame, two spaced-apart side rails and two spaced-apart end rails, the two spaced-apart side rails and two spaced-apart end rails cooperating to form a top opening of the playyard, a bassinet assembly mountable on the frame and including a cross-bar couplable to the playyard in a position spanning across the top opening at substantially a midpoint of each of the two spaced-apart side rails, and a fabric bassinet coupled to the cross-bar and configured to be extendable across a portion of the top opening and removably couplable to portions of the fabric frame cover overlying the two spaced-apart side rails and one of the two spaced-apart end rails, thereby placing the fabric bassinet in a use position;

further including a pair of side rail locking mechanisms, each side rail locking mechanism located at substantially a mid-point of one of the two spaced-apart side rails, and each side rail locking mechanism including a protruding element extending exterior to the playyard; and wherein the cross-bar includes a pair of frame connectors, each frame connector including a through-opening configured to be coupled to one of the protruding elements.

12. The playyard of claim 11, wherein each protruding element includes a ridge on a surface of the protruding element external to the playyard, the ridge configured to cooperate with the through-opening to removably couple the cross-bar to the pair of side rail locking mechanisms.

13. The playyard of claim 12, wherein each of the frame connectors includes a free end configured to be manipulable by a person's finger to uncouple each frame connector from a respective protruding element.

14. A playyard comprising a frame including a fabric frame cover, two side rails and first and second end rails, the two side rails and the first and second end rails cooperating to form a top opening of the playyard, a bassinet assembly including a cross-bar mountable on the frame at a midpoint of each of the two side rails and configured to span across the top opening, and a fabric bassinet coupled to the cross-bar and removably coupled in a use position across a portion of the top opening to portions of the fabric frame cover overlying the two side rails and the first end rail, a plurality of bassinet connectors on the fabric bassinet and a plurality of receivers on the fabric frame cover, each of the bassinet connectors being removably couplable in an upward direction toward the top opening to one of the plurality of receivers on the fabric frame cover to form a first coupling, and when an upward or downward force is exerted on the fabric bassinet in a use position from within the top opening, each of the first couplings remain coupled, thereby preventing an uncoupling of the fabric bassinet from the fabric frame cover.

15. The playyard of claim 14, wherein the cross-bar includes a pair of frame connectors couplable to side rail locking mechanisms on each side rail.

16. The playyard of claim 15, wherein each frame connector includes an elongated side having a through-opening and each side rail locking mechanism includes a protruding element, the through-opening and protruding element configured to cooperate to removably couple the cross-bar to the frame.

17. The playyard of claim 16, wherein the elongated side includes a lip configured to be manipulable by a person's finger to uncouple the frame connector from the protruding element, thereby permitting an uncoupling of the cross-bar from the frame.

18. The playyard of claim 14, wherein the plurality of bassinet connectors includes U-shaped clips and the plurality of receivers includes loops formed on an exterior surface of the fabric frame cover.

19. The playyard of claim 14, wherein the fabric bassinet includes a pair of fabric connectors and the fabric frame cover includes a pair of fabric receivers, each fabric connector and fabric receiver configured to cooperate to form a second coupling, each second coupling configured to minimize the size of a gap formed between the fabric bassinet and the fabric frame cover.

20. The playyard of claim 19, wherein the second couplings being located immediately adjacent an intersection of one of the two spaced-apart end rails and the two spaced-apart side rails, and the second couplings cooperating with the first couplings to prevent an uncoupling of the fabric bassinet from the fabric frame cover when an upward force is exerted on the fabric bassinet in a use position from within the top opening.

21. A playyard comprising frame including a fabric frame cover overlying the frame, two space-apart side rails and two spaced-apart end rails, the two spaced-apart side rails and two spaced-apart end rails cooperating to form a top opening of the playyard, a fabric bassinet including a cross-bar mountable on the frame across the top opening at substantially a midpoint of each of the two spaced-apart side rails, and means for coupling the fabric bassinet to the fabric frame cover in a use position and to maintain the fabric bassinet in the use position when an upward or downward force is exerted on the fabric bassinet from within the top opening; and wherein the means includes connectors on the fabric bassinet and receivers on the fabric frame cover configured to be coupled together.

22. The playyard of claim 21, wherein the connectors are U-shaped clips and the receivers are loops.

23. The playyard of claim 22, wherein each of the U-shaped clips is coupled to one of the loops in an upward direction toward the top opening to form a coupling and when one or more of an upward and downward force is exerted from within the top opening on the fabric bassinet in the use position, each coupling remains coupled and prevents an undesired uncoupling of the fabric bassinet from the fabric frame cover.

* * * * *